US007420453B2

(12) United States Patent
Matsumura et al.

(10) Patent No.: US 7,420,453 B2
(45) Date of Patent: Sep. 2, 2008

(54) FUSIBLE LINK UNIT

(75) Inventors: Norio Matsumura, Shizuoka-ken (JP); Shinya Onoda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 261 days.

(21) Appl. No.: 11/017,765

(22) Filed: Dec. 22, 2004

(65) Prior Publication Data

US 2005/0285709 A1 Dec. 29, 2005

(30) Foreign Application Priority Data

Dec. 24, 2003 (JP) ..... P2003-428022

(51) Int. Cl.
*H01H 85/08* (2006.01)
*H01H 69/02* (2006.01)
*H01R 33/95* (2006.01)

(52) U.S. Cl. ..... 337/295; 337/159; 337/261; 337/256; 337/227

(58) Field of Classification Search ..... 337/227, 337/295, 256, 159, 161
See application file for complete search history.

(56) References Cited

U.S. PATENT DOCUMENTS 5,438,310 A * 8/1995 Ikari ..... 337/208
5,643,693 A * 7/1997 Hill et al. ..... 429/121
5,645,448 A * 7/1997 Hill ..... 439/522
5,886,611 A * 3/1999 Schaller et al. ..... 337/189
6,476,705 B1 * 11/2002 Betti et al. ..... 337/161
2001/0011939 A1 * 8/2001 Inaba et al. ..... 337/265
2002/0163416 A1 * 11/2002 Matsumura ..... 337/112
2003/0022536 A1 1/2003 Saito et al.
2004/0115991 A1 * 6/2004 Higuchi et al. ..... 439/621
2004/0132335 A1 * 7/2004 Kosuge ..... 439/522
2005/0116805 A1 * 6/2005 Taga et al. ..... 337/159

FOREIGN PATENT DOCUMENTS

DE 296 20 424 U1 1/1997
DE 196 46 264 A1 5/1998
EP 0 906 853 A2 4/1999
JP 2000-182506 6/2000

* cited by examiner

*Primary Examiner*—Anatoly Vortman
(74) *Attorney, Agent, or Firm*—Finnegan, Henderson, Farabow, Garrett & Dunner, L.L.P.

(57) ABSTRACT

A fusible link unit is provided with a first alternator terminal including a screw hole configured to be connected with an opposite terminal with a screw, a second alternator terminal including a connector configured to be connected with an opposite connector, a battery terminal one or more load terminals respectively including one or more fuse links, wherein the first alternator terminal, the second alternator terminal, the battery terminal, the load terminals and the fuse links are mutually connected and unitized in a fuse unit.

6 Claims, 5 Drawing Sheets

FUSIBLE LINK UNIT

BACKGROUND OF THE INVENTION

1. Field of the Invention

The present invention relates to a fusible link unit having a plurality of fuse units respectively having fuse links.

2. Description of the Related Art

Vehicles are equipped with various electric devices and, for protection thereof from over-current, provided with fusible link units. The fusible link unit is ordinarily provided with a plurality of fuse units and an insulator case partially covering the fuse units. Each of the fuse units is provided with a fuse link, a busbar, terminals respectively connected with a load and a battery. Japanese Patent Application Laid-open No. 2000-182506 discloses a related art.

Some types of the fusible link units are further provided with input portions for input from the alternators. In certain cases, the input portion is required to permit high-current and is hence provided with a terminal to which a terminal fitting is screwed. In other cases, it is enough that the input portion is provided with a male connector for mating with a female connector of the alternator. They are different from each other in view of the whole constitutions thereof.

SUMMARY OF THE INVENTION

Required capacities for the input portions vary depending on the types of the vehicles and hence both aforementioned types of fusible link units must be reserved for manufacturing the vehicles. Moreover, the vehicles per se are subject to design change for housing both types of fusible link units. Provided that one fusible link unit is capable of meeting the variety of requirements in the capacities, such fusible link provides easiness of installation thereof and designing of the vehicle and decrease in the number of parts. The present invention is achieved in view of the above problem.

According to an aspect of the present invention, a fusible link unit is provided with a first alternator terminal including a screw hole configured to be connected with an opposite terminal with a screw; a second alternator terminal including a connector configured to be connected with an opposite connector; a battery terminal; and one or more load terminals respectively including one or more fuse links, wherein the first alternator terminal, the second alternator terminal, the battery terminal, the load terminals and the fuse links are mutually connected and unitized in a fuse unit.

Preferably, the battery terminal is configured to link with a battery without a cable. More preferably, the battery terminal is configured to link with a battery via a cable.

DETAILED DESCRIPTION OF THE PREFERRED EMBODIMENT

A first embodiment of the present invention will be described hereinafter with reference to FIGS. 1 and 2.

Figure 1:
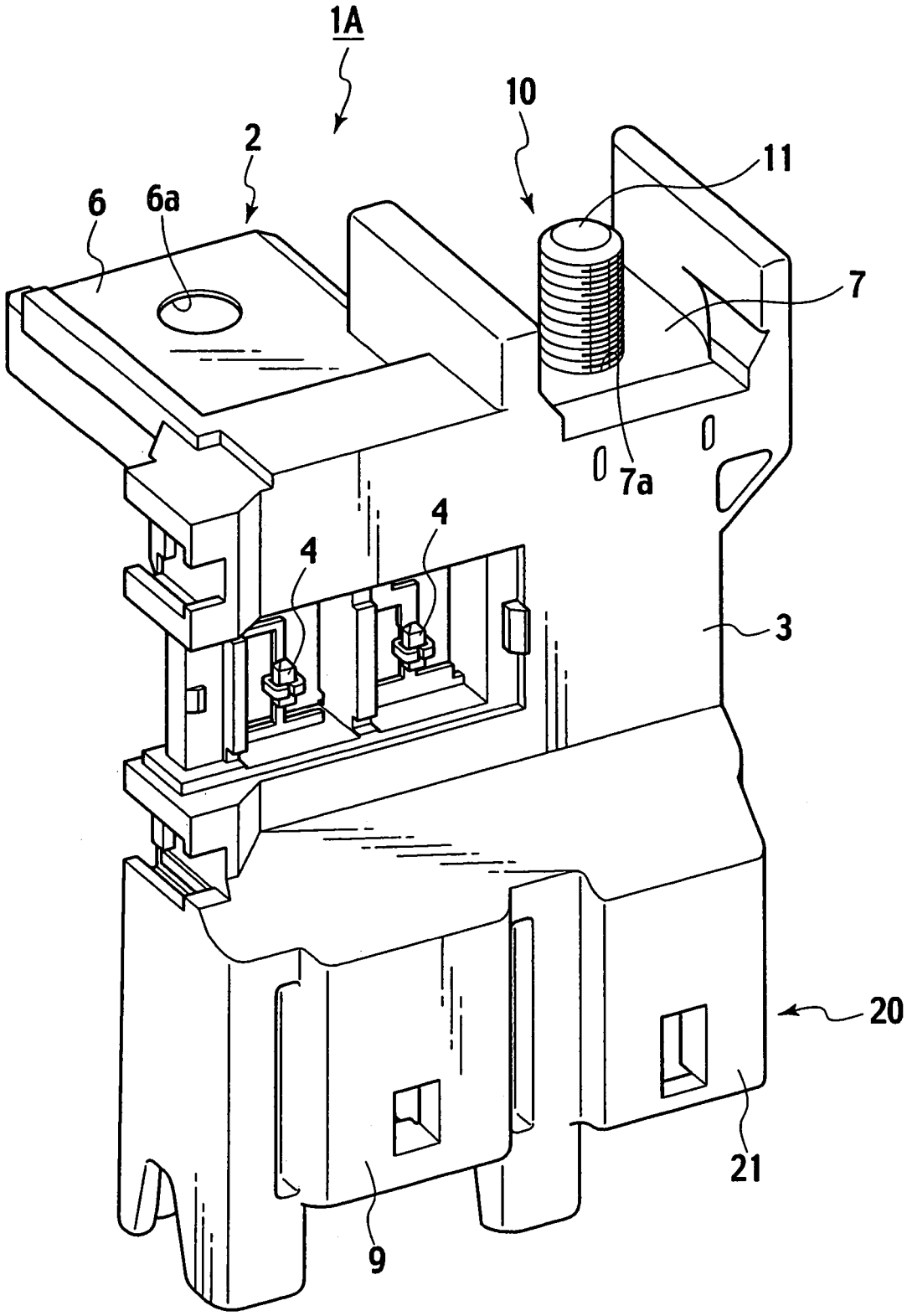
FIG. 1 is a perspective view of a fusible link unit according to a first embodiment of the present invention.
Figure 2:
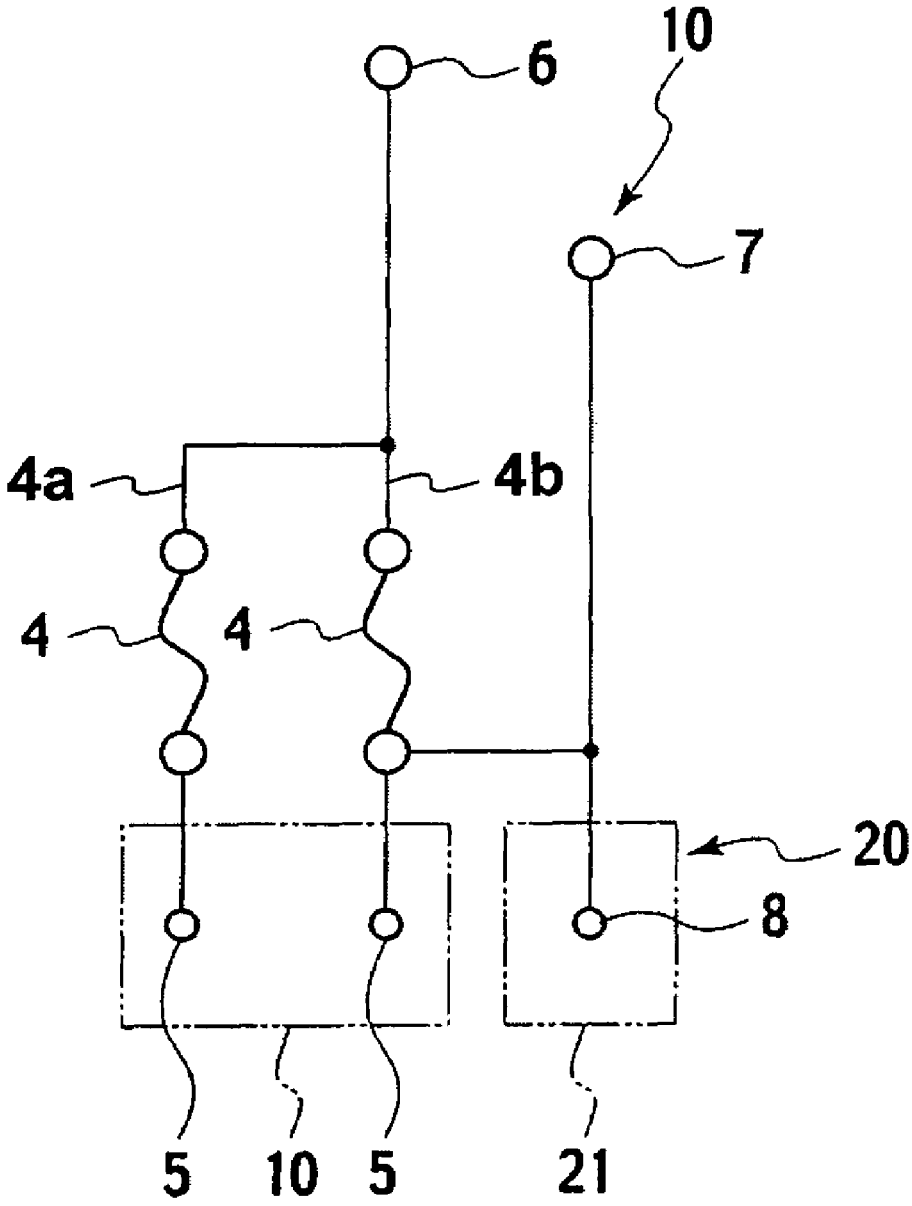
FIG. 2 is a circuit diagram of the fusible link unit according to the first embodiment of the present invention.
Figure 3:
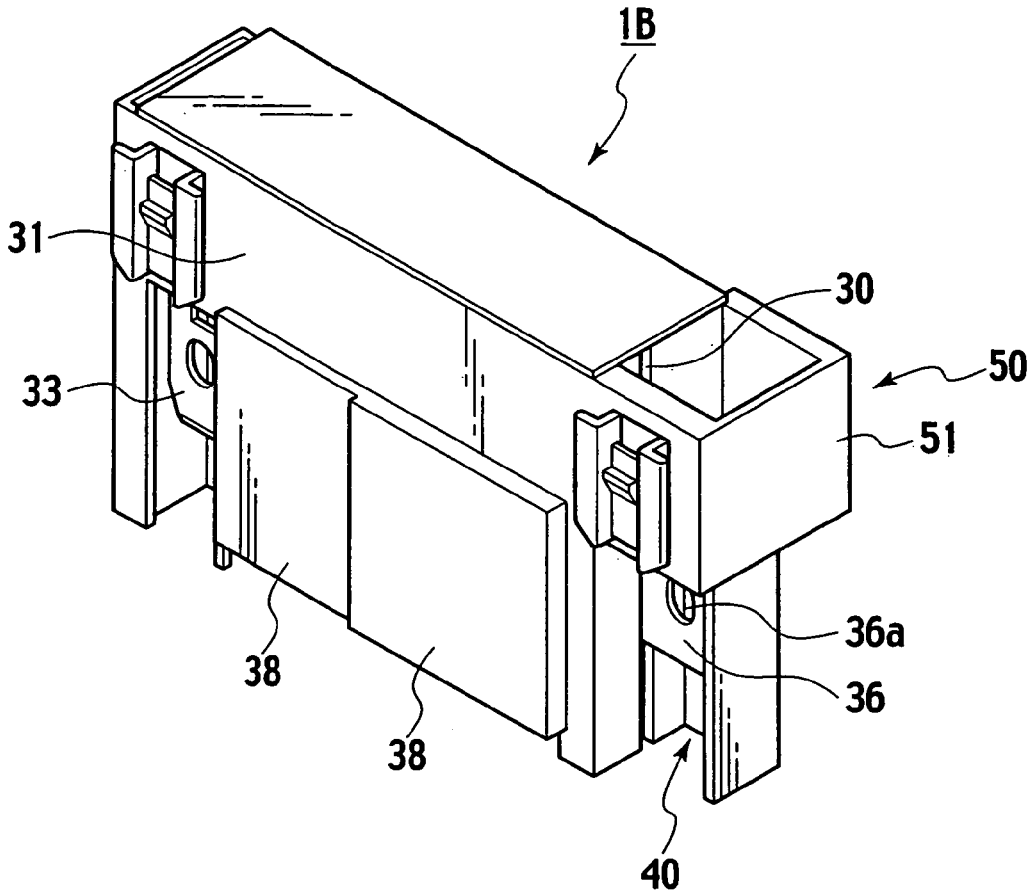
FIG. 3 is a perspective view of a fusible link unit according to a second embodiment of the present invention.
Figure 4:
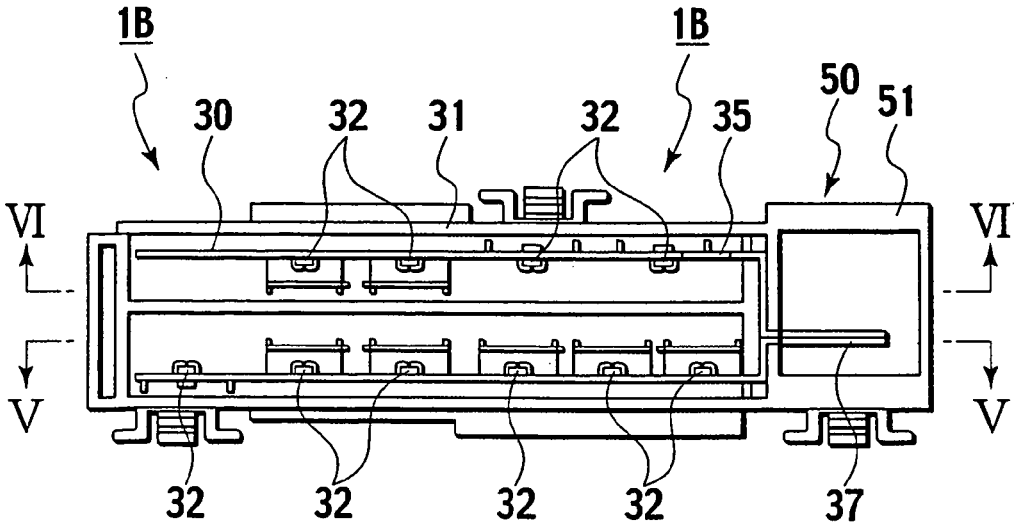
FIG. 4 is a plan view of the fusible link unit according to the second embodiment of the present invention.

A fusible link unit 1A is, as shown in FIG. 1, provided with a fuse unit 2, a detail of which is shown in FIG. 2, and a casing 3 partially covering the fuse unit 2. A whole shape of the fusible link unit 1A is so dimensioned as to fit a car battery and hence can be directly installed on the battery.

The fuse unit 2 is provided with a pair of fuse links 4, a pair of load terminals 5, a battery terminal 6, a first alternator terminal 7 and a second alternator terminal 8 as shown in FIG. 2. The fuse links 4 are connected in parallel with the respective load terminals 5. Both the first alternator terminal 7 and the second alternator terminal 8 are connected to one of the fuse links 4.

Each of the fuse links 4 is a piece made of a low-melting metal and configured to melt when a current beyond a respectively predetermined value flows therethrough. The fuse links 4 are crimped on respective lines 4*a* and 4*b* shaped in a narrow cranked shape.

The load terminals 5 are male contact for connection with the respective load (not shown) and are housed in a connector housing 9 formed at a lower part of the casing 3.

The battery terminal 6 is provided with a screw hole 6*a* to which a terminal fitting (not shown) for connection with the battery is connected with a screw (not shown). The terminal fitting is further connected to a battery post (not shown) of the battery. Thereby, the battery terminal 6 is connected to the battery without any cable.

A first alternator input portion 10 is formed of the first alternator terminal 7 and a second alternator input portion 20 is formed of the second alternator terminal 8.

The first alternator input portion 10 is provided with a screw hole 7*a* formed on the first alternator terminal 7 and a bolt 11 screwed in the screw hole 7*a*. Thereby the first alternator input portion 10 is configured to be connectable with an opposite terminal (not shown) of the alternator with a screw.

The second alternator input portion 20 is provided with the second alternator terminal 8 formed in a male terminal shape connectable with a female connector and are housed in a connector housing 21 formed at a lower part of the casing 3. An opposite terminal (not shown) of the alternator is fixed with the second alternator input portion 20 via the connector.

In a case where a current capacity of the alternator is relatively large, the opposite terminal of the alternator is connected to the first alternator input portion 10 with the screw. On the contrary, in a case where a current capacity of the alternator is relatively small, the opposite terminal of the alternator is connected to the second alternator input portion 20 with the connector. Thereby the fusible link unit 1A is capable of permitting any of the screw connection and the connector connection and is hence capable of selective permission of high-current and low-current.

The fusible link unit 1A conducts and distributes electric power supplied by both the battery and the alternator to the respective load via the load terminals 5. In a case where a remaining battery level is short, the battery receives the electric power from the alternator so as to be charged. Provided that over-current caused by any trouble at the loads flows through any of the fuse links 4, the fuse link 4 melts to shut off the current therethrough and thereby succeeding accidents are prevented beforehand.

A second embodiment of the present invention will be described hereinafter with reference to FIGS. 3 through 7.

A fusible link unit 1B is, in contrast with the aforementioned fusible link unit 1A according to the first embodiment, installed separately from the battery as shown in FIG. 3 through 6. The fusible link unit 1B is provided with a fuse unit 30 comprised of a busbar press-formed from a conductive sheet and an insulator casing 31 partly covering the fuse unit 30.

Figure 5:
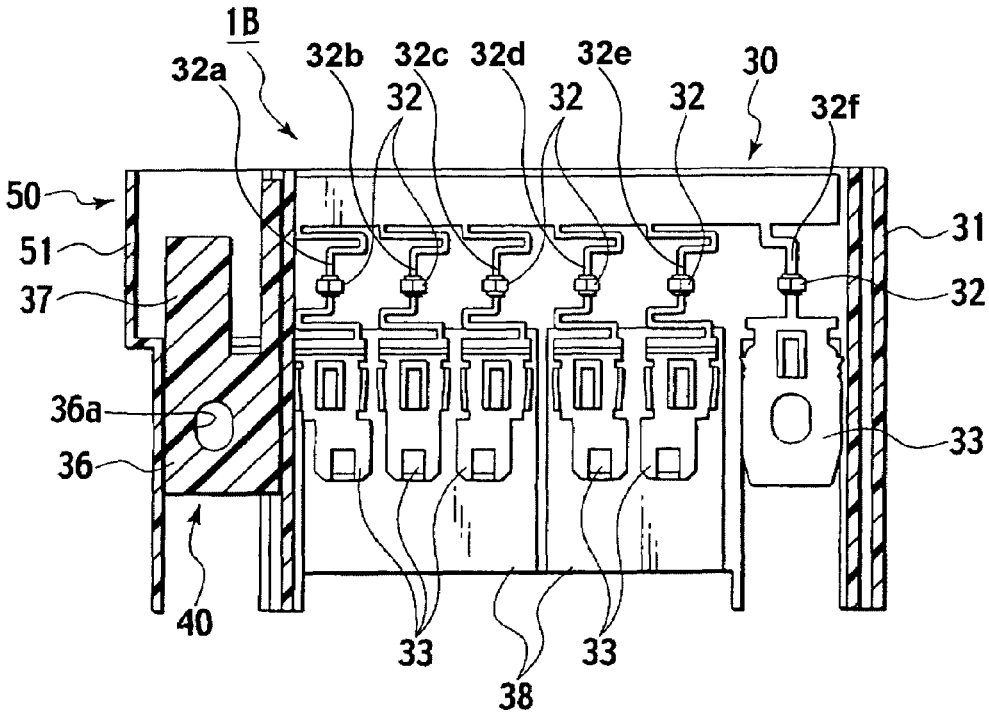
FIG. 5 is a cross sectional view of the fusible link unit, taken from a line V-V of FIG. 4.
Figure 6:
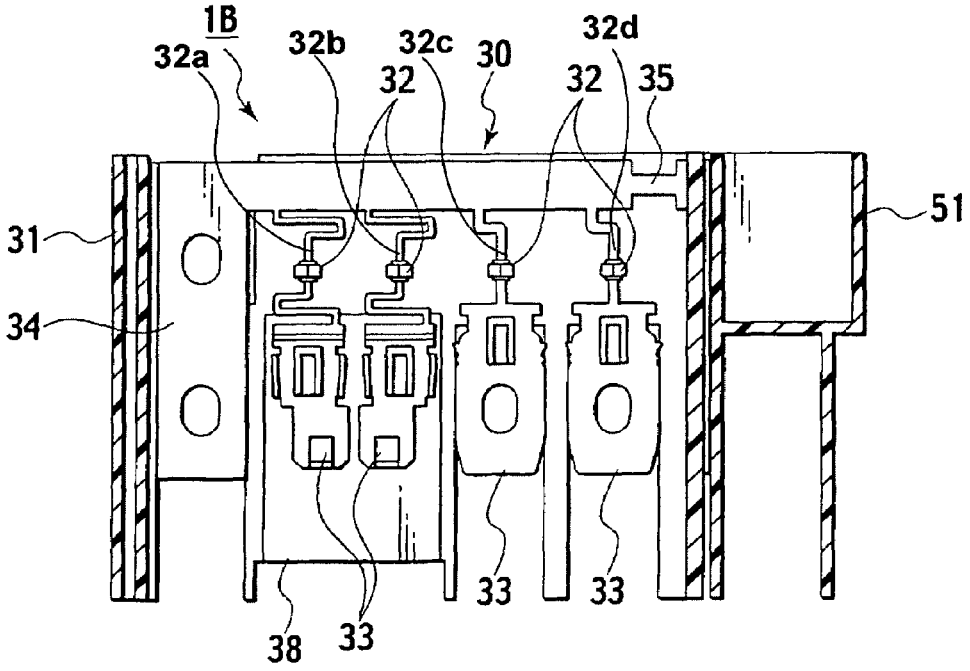
FIG. 6 is a cross sectional view of the fusible link unit, taken from a line VI-VI of FIG. 4.
Figure 7:
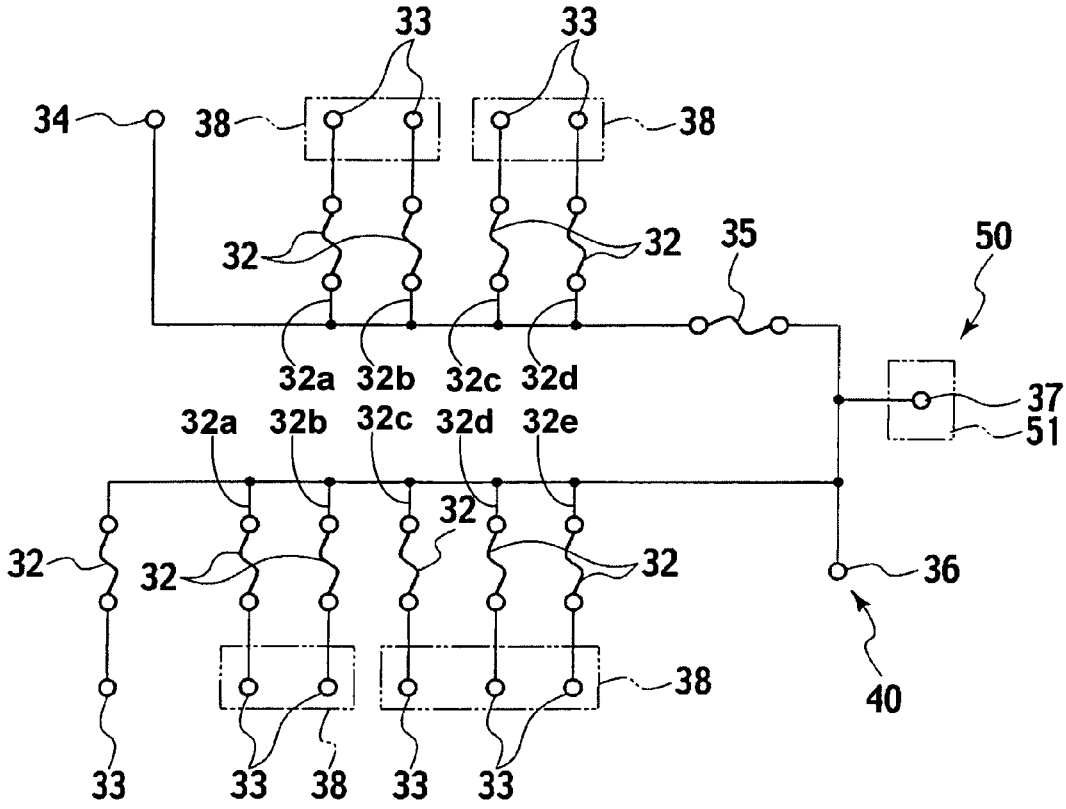
FIG. 7 is a circuit diagram of the fusible link unit according to the second embodiment of the present invention.

The fuse unit 30 is provided with a plurality of fuse links 32 and load terminals 33 connected in parallel, a battery terminal 34, a fuse link 35 for the alternator, a first alternator terminal 36 and a second alternator terminal 37, which forms a circuit shown in FIG. 7. Each of the fuse links 32 is a piece made of a low-melting metal and configured to melt when a current beyond a respectively predetermined value flows therethrough. The fuse links 32 are crimped on respective lines 34*a*-34*f* shaped in a narrow cranked shape, as illustrated in FIG. 5.

The load terminals 33 are male contact for connection with the respective load (not shown) and are housed in a connector housing 38 formed at a lower part of the casing 31.

The battery terminal 34 is provided with a screw hole (not shown) to which a terminal fitting of a cable (not shown) for connection with the battery is connected with a screw (not shown) According to the present embodiment, the battery terminal 34 is connected to the battery via the cable.

The fuse link 35 for the alternator is also configured to melt when a current beyond a respectively predetermined value flows therethrough. The fuse link 35 is crimped on a line shaped in a narrow relatively straight shape.

A first alternator input portion 40 is formed of the first alternator terminal 36 and a second alternator input portion 50 is formed of the second alternator terminal 37.

The first alternator input portion 40 is provided with a screw hole 36*a* formed on the first alternator terminal 36, exposed outward from the casing 31. Thereby the first alternator input portion 40 is configured to be connectable with an opposite terminal (not shown) of the alternator with a screw.

The second alternator input portion 50 is provided with the second alternator terminal 37 formed in a male terminal shape connectable with a female connector and are housed in a connector housing 51 formed at a lower part of the casing 31. An opposite terminal (not shown) of the alternator is fixed with the second alternator input portion 50 via the connector.

In a case where a current capacity of the alternator is relatively large, the opposite terminal of the alternator is connected to the first alternator input portion 40 with the screw. On the contrary, in a case where a current capacity of the alternator is relatively small, the opposite terminal of the alternator is connected to the second alternator input portion 50 with the connector. Thereby the fusible link unit 1B is capable of permitting any of the screw connection and the connector connection and is hence capable of selective permission of high-current and low-current.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A fusible link unit, comprising:

a first alternator terminal including a screw hole configured to be connected with an opposite terminal with a screw;

a second alternator terminal formed in a male terminal shape connectable with a female connector;

a battery terminal;

one or more fuse links; and one or more load terminals;

wherein each of the load terminals connects to the battery terminal through each of the fuse links, wherein the first alternator terminal connects directly to the second alternator terminal, wherein the first and second alternator terminals connect to one of the load terminals, and wherein the first alternator terminal and the battery terminal extend in a direction perpendicular to a direction in which the female connector engages the second alternator terminal.

2. The fusible link unit of claim 1, wherein the battery terminal is configured to link with a battery without a cable.

3. The fusible link unit of claim 1, wherein:

the first alternator terminal is configured to be connected to an alternator having a large current capacity; and the second alternator terminal is configured to be connected to an alternator having a small current capacity.

4. The fusible link unit of claim 1, wherein the fuse links are made of a low-melting metal.

5. The fusible link unit of claim 1, wherein each of the fuse links is crimped on a respective line connecting the load terminal and the battery terminal.

6. The fusible link unit of claim 5, wherein each respective line is shaped in a narrow cranked shape.

* * * * *